US007962980B2

(12) United States Patent
Stephens et al.

(10) Patent No.: US 7,962,980 B2
(45) Date of Patent: Jun. 21, 2011

(54) APPARATUS FOR CONTINUOUS COLLECTION OF HUMAN WASTE PRODUCTS AND METHOD FOR INCONTINENCE MANAGEMENT

(76) Inventors: Lynn Babb Stephens, Dothan, AL (US); George Gregory Stephens, Dothan, AL (US)

( * ) Notice: Subject to any disclaimer, the term of this patent is extended or adjusted under 35 U.S.C. 154(b) by 0 days.

(21) Appl. No.: 12/786,532

(22) Filed: May 25, 2010

(65) Prior Publication Data

US 2010/0229305 A1 Sep. 16, 2010

Related U.S. Application Data

(63) Continuation of application No. 12/541,490, filed on Aug. 14, 2009.

(60) Provisional application No. 61/108,852, filed on Oct. 27, 2008.

(51) Int. Cl.
*A61G 7/047* (2006.01)

(52) U.S. Cl. ..... 5/604

(58) Field of Classification Search ..... 5/600, 604, 5/694–695; 4/450–456
See application file for complete search history.

(56) References Cited

U.S. PATENT DOCUMENTS

| | | | | | |
|---|---|---|---|---|---|
| 1,604,205 | A * | 10/1926 | Tiffany | ..... | 5/695 |
| 3,849,811 | A * | 11/1974 | Cyll | ..... | 5/604 |
| 4,021,870 | A * | 5/1977 | Walters | ..... | 5/484 |
| 4,244,066 | A * | 1/1981 | Rukawina | ..... | 5/691 |
| 6,578,219 | B1 * | 6/2003 | Gabel et al. | ..... | 5/710 |

* cited by examiner

*Primary Examiner* — Fredrick Conley
(74) *Attorney, Agent, or Firm* — Maier & Maier, PLLC

(57) ABSTRACT

According to at least one embodiment, an apparatus for continuous collection of human waste products is disclosed. The apparatus may include a bed frame, a lower plate having a container coupled thereto, an upper plate having an aperture defined therein, a mattress having an aperture defined therein, a mattress cover having an aperture defined therein and an absorbent pad having a bag coupled thereto. The apparatus may allow for continuous collection of human waste products while maintaining the patient in a comfortable position. The apparatus may further facilitate preventing human waste products from contacting the skin of the patient, thereby substantially reducing the occurrence of pressure ulcers. Additionally, the apparatus may reduce the need for the use of Foley catheters for incontinence management, thereby reducing the occurrence of urinary tract infections related to such use.

10 Claims, 2 Drawing Sheets

APPARATUS FOR CONTINUOUS COLLECTION OF HUMAN WASTE PRODUCTS AND METHOD FOR INCONTINENCE MANAGEMENT

RELATED APPLICATIONS

This is a continuation application of U.S. patent application Ser. No. 12/541,490, filed on Aug. 14, 2009, which claims the benefit of priority under 35 U.S.C. §120 to U.S. provisional patent application No. 61/108,852, filed Oct. 27, 2008, the disclosures of which are incorporated by reference herein in their entireties.

BACKGROUND

Bedridden and incontinent patients typically require continuous care to dispose of human waste products. Typically, bedridden patients may relieve themselves into a separate receptacle that is then replaced by a caretaker. As the patient has to adjust their position to use the receptacle, such a method of relief may be cause discomfort to the patient for physical reasons as well as for reasons of embarrassment.

Patients unable to move, as well as incontinent patients, are typically incapable of using a separate receptacle for relief. In such cases, human waste products are typically collected on an absorbent pad or similar device that may be fastened to the patient's bed or to the patient themselves. However, such devices are incapable of preventing human waste products from contacting the skin of the patient due to compression of the absorbent pad by the patient's weight. Consequently, the patient may develop pressure ulcers from continued contact with the waste products. Additionally, the necessity of having a caretaker change an unclean absorbent pad may cause further embarrassment for the patient.

Other alternatives for waste collection for bedridden and incontinent patient include waste collection receptacles that may be inserted into a cavity defined in a mattress while the patient is relieving themselves. However this alternative does not prevent the human waste products from contacting the patient's skin due to compression of the mattress and may be difficult to remove while the patient remains on the bed. A similar alternative involves adding a mattress overlay device to address the problem of mattress compression; however for reasons of patient comfort and other factors the device needs to be installed when the patient is ready to relieve themselves and removed immediately following relief, making such a device unsuitable for incontinent patients. Another alternative involves inflating a mattress and inserting a waste collection receptacle into a cavity defined in the mattress when the mattress is inflated; however, this device must similarly be inserted when the patient is ready for relief and removed immediately thereafter, thereby making continuous collection of human waste products impossible.

SUMMARY

According to at least one embodiment, an apparatus for continuous collection of human waste products is disclosed. The apparatus may allow for continuous collection of human waste products while maintaining the patient in a comfortable position. The apparatus may further facilitate preventing human waste products from contacting the skin of the patient, thereby substantially reducing the occurrence of pressure ulcers. Additionally, the apparatus may reduce the need for the use of Foley catheters for incontinence management, thereby reducing the occurrence of urinary tract infections related to such use. The apparatus for continuous collection of human waste products may also allow for an easy and efficient process of waste product disposal, thereby reducing the physical and emotional discomfort of the patient.

The apparatus for continuous collection of human waste products may include a bed frame, a lower plate having a container coupled thereto, an upper plate having an aperture defined therein, a mattress having an aperture defined therein wherein the mattress is noncollapsable in the vicinity of the aperture, a mattress cover covering the top, bottom, and sides of the mattress and having an aperture defined therein and an absorbent pad having a bag coupled thereto. The absorbent pad may be placed on top of the mattress or the mattress cover with the bag of the absorbent pad being received through the apertures of the mattress cover, mattress, and upper plate and within the container of the lower plate.

According to another embodiment, a method for incontinence management is disclosed. The method for incontinence management may include placing an absorbent pad having a bag coupled thereto into an aperture in a mattress, positioning the patient comfortably over the aperture, separating the waste products from the patient's skin by collecting the waste products in the bag, and replacing the absorbent pad while reducing the physical and emotional discomfort of the patient.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
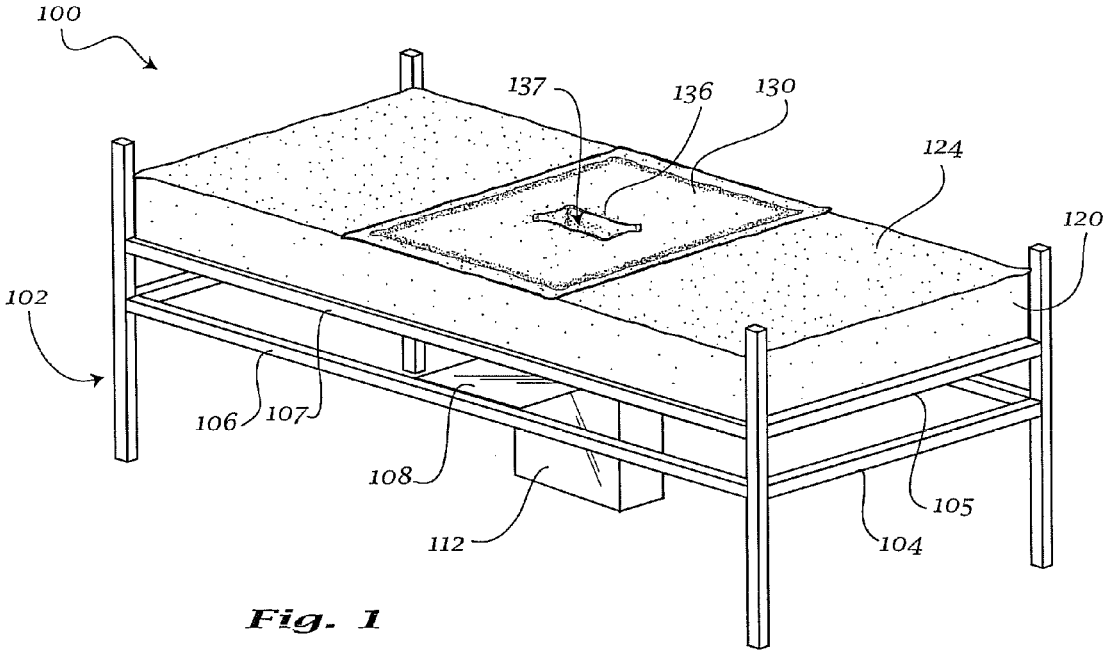
FIG. 1 is an isometric view of an exemplary embodiment of an apparatus for continuous collection of human waste products.
Figure 2:
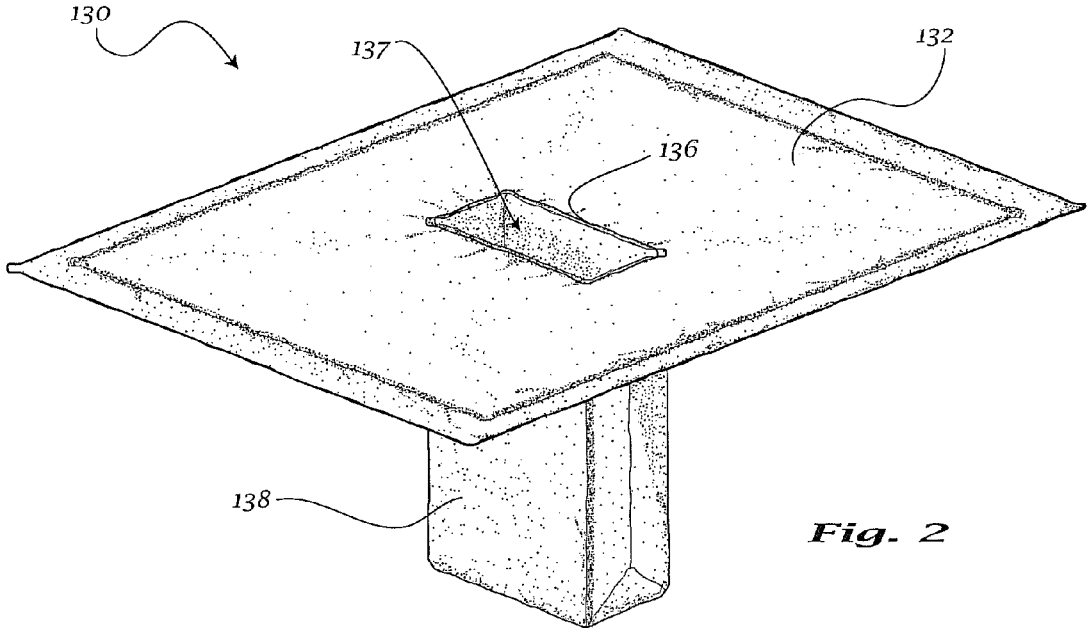
FIG. 2 is an isometric view of an exemplary embodiment of an absorbent pad having a bag coupled thereto.
Figure 3:
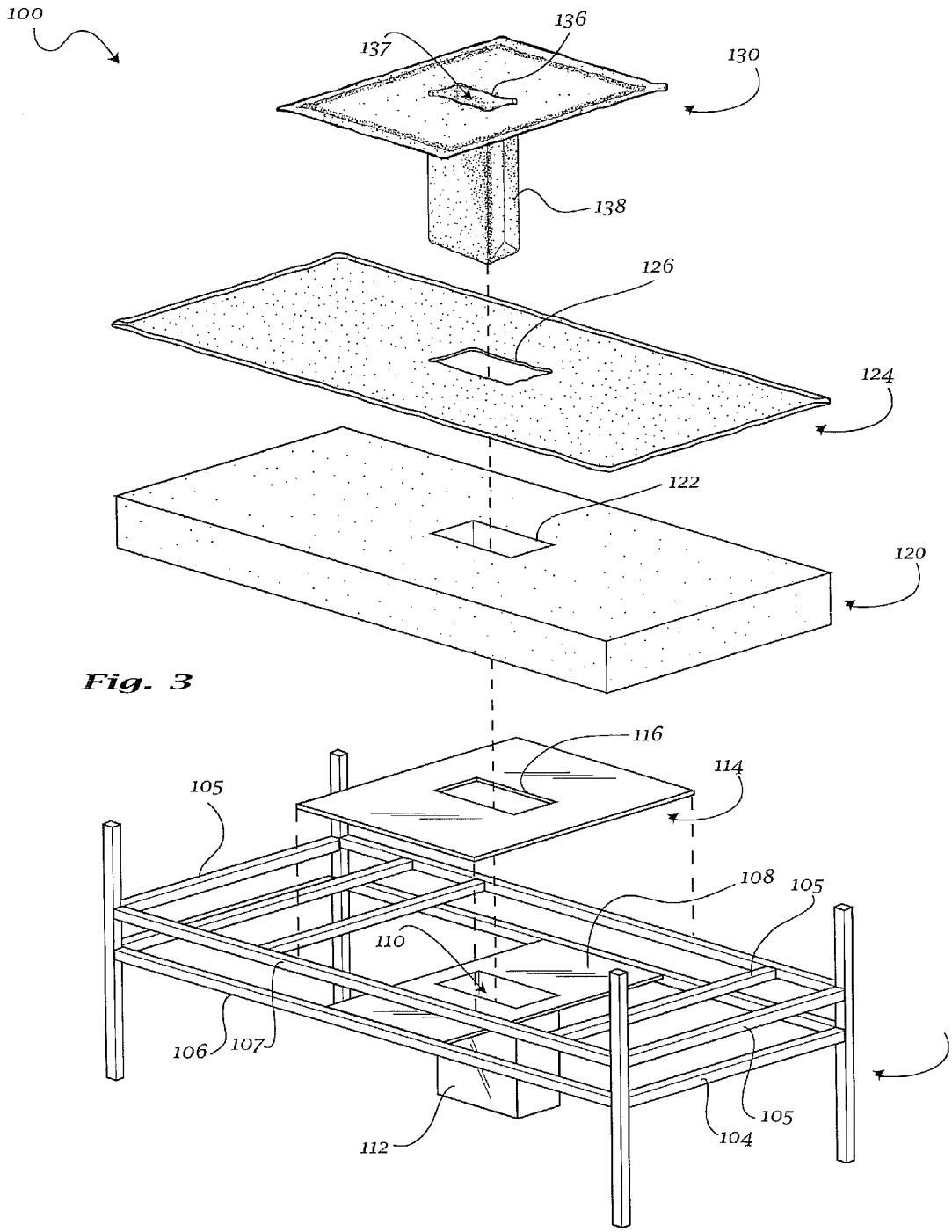
FIG. 3 is an exploded isometric view of an exemplary embodiment of an apparatus for continuous collection of human waste products.

Referring to FIGS. 1-3, an exemplary embodiment of an apparatus for continuous collection of human waste products 100 may include a bed frame 102, lower plate 108, upper plate 114, mattress 120, at least one mattress cover 124, and absorbent pad 130.

Bed frame 102 may be made of metal, such as, for example, welded steel, or any other suitable construction known to one having ordinary skill in the art. In one embodiment, bed frame 102 may be sized to accommodate a mattress having a length of about 80 inches and a width of about 38 inches, such as, for example, a long size twin mattress. Bed frame 102 may include a pair of lower transverse rails 104 and a pair of lower longitudinal rails 106. Bed frame 102 may also include a plurality of upper transverse rails 105 and a pair of upper longitudinal rails 106. In one embodiment, bed frame 102 may incorporate a support platform (not shown) such as, for example the support platform disclosed in U.S. Pat. No. 7,237,289, or any other support platform known to one having ordinary skill in the art. In one embodiment, the structure of bed frame 102, lower longitudinal rails 106, or a support platform included with bed frame 102 may allow for the elevation of the head portion of mattress 120 relative to the foot portion of mattress 120. In one embodiment, the head portion of mattress 120 may be elevated about 30 degrees relative to the horizontal plane. In one embodiment, bed frame 102 may be a semi-electric bed similar to Invacare Product No. 5310IVC or the like.

Absorbent pad 130 may be constructed of materials that facilitate the absorption of human waste products into the interior of the pad while resisting the passage of absorbed products to the outside of the pad. Absorbent pad 130 may be sized such that the length of absorbent pad 130 substantially corresponds to the width of mattress 120. In one embodiment, absorbent pad 130 may have a length of about 28 inches. Absorbent pad 130 may have a horizontal portion 132 and an aperture 136 defined substantially in the center thereof Aperture 136 may have a substantially rectangular shape, with the longitudinal axis of aperture 136 being positioned transversely to the longitudinal axis of absorbent pad 130. Absorbent pad 130 may also include bag 138. Bag 138 may be constructed of polyethylene or any other material that facilitates isolation of human waste products that is known to a person having ordinary skill in the art. Bag 138 may be coupled to absorbent pad 130 such that the upper edges of bag 138 are coterminous with the edges of aperture 136, thereby defining a cavity 137 such that the inner surface of cavity 137 is contiguous with the upper surface of absorbent pad 130. Human waste products may therefore be collected within cavity 137 of bag 138, thereby facilitating keeping away human waste products from contact with the skin of the patient. In one embodiment, cavity 137 may have a width of about 5 inches, a length of about 10 inches, and a depth of about 8 inches.

Apparatus for continuous collection of human waste products 100 may include at least one mattress cover 124. At least one mattress cover 124 may include an impermeable layer that facilitates protecting the top of mattress 120 from moisture and contamination. In one embodiment, mattress cover 124 may be an Advanced Performance Non-Vinyl Mattress Protector manufactured by Tempur-Pedic International, Inc. In another embodiment, mattress cover 124 may be constructed of a vinyl or similar material. In another embodiment, mattress covers 124 may be constructed of polyester fabric and manufactured by Dartex. With respect to this particular embodiment, mattress cover 124 may include an impermeable layer that facilitates protecting top, bottom and sides of mattress 120 from moisture and contamination. A mattress cover 124 may also be a bed sheet constructed of a fabric material or any other material known to one having ordinary skill in the art.

In one embodiment, mattress cover 124 may be sized to substantially cover the top of a mattress having a length of about 80 inches and a width of about 38 inches, such as, for example, a long size twin mattress. In another embodiment, mattress cover 124 may be sized to cover the top, bottom and sides of a mattress having a length of about 80 inches, a width of about 38 inches and a thickness of about 8 inches. Mattress cover 124 may also include an aperture 126 defined substantially near the midpoint of the transverse axis of mattress cover 124, wherein the longitudinal axis of aperture 126 may be substantially parallel to the longitudinal axis of mattress cover 124. Aperture 126 may have dimensions that facilitate receiving bag 138 within aperture 126. In one embodiment, aperture 126 may have a width of about 5 inches and a length of about 10 inches.

Apparatus for continuous collection of human waste products 100 may also include mattress 120. Mattress 120 may include an aperture 122 defined substantially near the midpoint of the transverse axis of mattress 120, wherein the longitudinal axis of aperture 122 may be substantially parallel to the longitudinal axis of mattress 120. Aperture 122 may have dimensions that facilitate receiving bag 138 within aperture 122. Aperture 122 may also have dimensions that facilitate increasing patient comfort while the patient is lying on mattress 120. In one embodiment, aperture 122 may have a width of about 5 inches and a length of about 10 inches.

Mattress 120 may facilitate maintaining the patient's body in a comfortable position. Mattress 120 may also facilitate maintaining the patient's rectum and urethra above aperture 122, thereby facilitating the collection of human waste products within cavity 137 of absorbent pad 130. In one embodiment, mattress 120 may include a layer that may be constructed from a polyurethane foam with low rebound properties, such that the mattress may mold to the body of the patient, thereby further facilitating the maintenance of the patient's anus and urethra above aperture 122. For example, in one embodiment, mattress 120 may be a mattress manufactured by Tempur-Pedic International, Inc. In another embodiment, mattress 120 may be constructed of any material known to one having ordinary skill in the art that facilitates maintaining the patient in the position described herein. An example of another embodiment for mattress 120 is a mattress manufactured by Tempur-Pedic Medical. This particular mattress facilitates maintaining the patient in the position described herein, including facilitating the maintenance of the patient's body in a comfortable position. This particular mattress is also constructed of a material that is non collapsible in the vicinity of aperture 122, thereby facilitating keeping away human waste products collected within cavity 137 of bag 138 from contact with the skin of the patient. With respect to this particular mattress manufactured by Tempur-Pedic Medical, upper plate 114, lower plate 108 and container 112 will not be needed.

While bed frame 102 may include a plurality of upper transverse rails 105 that facilitate providing support to mattress 120, the presence of bag 138 may interfere with the placement of upper transverse rails 105 proximate to the central portion of bed frame 102. To facilitate providing support to the central portion of mattress 107, upper plate 114 may engage upper longitudinal rails 107 or any analogous of bed frame 102. Upper plate 114 may include an aperture 116 defined substantially therein, such that when upper plate 116 is coupled to bed frame 102, aperture 116 may receive bag 138 within aperture 116. Aperture 116 may have dimensions that facilitate receiving bag 138 within aperture 116. In one embodiment, aperture 116 may have a width of about 5 inches and a length of about 10 inches.

Lower plate 108 may engage the lower longitudinal rails 106 or any analogous structure of bed frame 102. Lower plate 108 may include container 112 coupled thereto, container 112 defining a cavity 110 that is sized to receive bag 138 of absorbent pad 130 therein. Container 112 may facilitate supporting bag 138 when apparatus 100 is in use. Consequently, when bag 138 contains human waste, container 112 may provide support to bag 138 and its contents, thereby reducing tension on bag 138 and reducing the likelihood of absorbent pad 130 shifting in position.

In operation, the caretaker may place absorbent pad 130 on the top surface of mattress 120 or mattress cover 124 and insert bag 138 into cavity 110 of lower support plate 108. Alternatively, if the Tempur-Pedic Medical mattress described in paragraph [0018] is used, insert bag 138 into aperture 122. This alternative therefore eliminates the need to insert bag 138 into cavity 110 of lower plate 108. The patient may then lie on apparatus 100 such that the patient's anus and urethra are comfortably positioned substantially over the center of aperture 136 of absorbent pad 130. The caretaker may desire to raise the head portion of mattress 120 to provide comfort to the patient and to increase the effectiveness of apparatus 100 in collecting human waste products from the patient. For example, raising the head portion of mattress 120 to 20 degrees above the horizontal may further increase the effectiveness of collecting urine waste from female patients, while raising the head portion of mattress 120 to 30 degrees above the horizontal may further increase the effectiveness of collecting urine waste for male patients. The apparatus thus allows for continuous collection of human waste products while the patient is lying on mattress 120.

To replace absorbent pad 130, the caretaker may roll the patient onto their side such that they are located on one side of mattress 120. The caretaker may then gather and compact half of horizontal portion 132 such that cavity 110 of bottom plate 112 is accessible. The caretaker may then place a replacement absorbent pad onto mattress 120, roll out half of horizontal portion 132 of the replacement pad, and insert bag 138 of the replacement pad into cavity 110. The patient may then be rolled onto their other side such that they are located on the opposite side of mattress 120. The caretaker may then withdraw the used absorbent pad and roll out the remaining half of horizontal portion 132 of the replacement pad. The patient may then be placed such that the patient's anus and urethra are comfortably positioned substantially over the center of aperture 136 of replacement absorbent pad 130, allowing for further continuous collection of human waste products from the patient.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for continuous collection of human waste products, comprising:

an absorbent pad having a horizontal portion with a first aperture defined therein and a receptacle for collecting human waste products coupled thereto, wherein the edges of the first aperture are coterminous with the upper portion of the receptacle for preventing any of said human waste products from contacting the skin of a patient;

a mattress having a second aperture defined therein, wherein the second aperture remains continuously open thereby allowing for the continuous collection of human waste, wherein the mattress is constructed of a material that is noncollapsable in the vicinity of the second aperture thereby facilitating keeping human waste products that are continuously collected within the receptacle away from contact with the patient's skin, wherein the mattress facilitates maintaining the patient's body in a comfortable position while the patient's anus and urethra are maintained continuously over the second aperture for the continuous collection of human waste products, wherein the horizontal portion of the absorbent pad is removably coupled to the top of the mattress such that the second aperture receives the receptacle of the absorbent pad and removal of the absorbent pad and the receptacle coupled thereto is accomplished from above the mattress;

a bed frame configured to support said mattress; and a lower plate coupled to an underside of said bed frame and having a container coupled thereto.

2. The apparatus of claim 1, wherein said container is configured to receive said receptacle.

3. The apparatus of claim 1, wherein said first and second apertures have a width of about 5 inches and a length of about 10 inches.

4. The apparatus of claim 1, wherein said mattress has a width of about 38 inches and a length of about 80 inches.

5. An apparatus for continuous collection of human waste products, comprising:

an absorbent pad having a horizontal portion with a first aperture defined therein and a receptacle for collecting human waste products coupled thereto, wherein the edges of the first aperture are coterminous with the upper portion of the receptacle for preventing any of said human waste products from contacting the skin of a patient;

a mattress having a second aperture defined therein, wherein the second aperture remains continuously open thereby allowing for the continuous collection of human waste, wherein the mattress is constructed of a material that is noncollapsable in the vicinity of the second aperture thereby facilitating keeping human waste products that are continuously collected within the receptacle away from contact with the patient's skin, wherein the mattress facilitates maintaining the patient's body in a comfortable position while the patient's anus and urethra are maintained continuously over the second aperture for the continuous collection of human waste products, wherein the horizontal portion of the absorbent pad is removably coupled to the top of the mattress such that the second aperture receives the receptacle of the absorbent pad and removal of the absorbent pad and the receptacle coupled thereto is accomplished from above the mattress;

a bed frame configured to support said mattress;

a lower plate coupled to an underside of said bed frame and having a container coupled thereto;

an upper plate coupled to said bed frame and having a third aperture defined therein; and a mattress cover covering a top, bottom, and sides of said mattress and having a fourth aperture defined therein.

6. The apparatus of claim 5, wherein said first aperture, said second aperture, said third aperture, said fourth aperture and said container are configured to receive said receptacle.

7. The apparatus of claim 5, wherein said first aperture, said second aperture, said third aperture, and said fourth aperture have a width of about 5 inches and a length of about 10 inches.

8. The apparatus of claim 5, wherein said mattress has a width of about 38 inches and a length of about 80 inches and a thickness of about 8 inches.

9. The apparatus of claim 5, wherein said mattress cover has an impermeable layer that protects said top, bottom and sides of said mattress from moisture and contamination.

10. An apparatus for continuous collection of human waste products, comprising:

an absorbent pad having a horizontal portion with a first aperture defined therein and a receptacle for collecting human waste products coupled thereto, wherein the edges of the first aperture are coterminous with the upper portion of the receptacle for preventing any of said human waste products from contacting the skin of a patient;

a mattress having a second aperture defined therein, wherein the second aperture remains continuously open thereby allowing for the continuous collection of human waste, wherein the mattress is constructed of a material that is noncollapsable in the vicinity of the second aperture, thereby facilitating keeping human waste products that are continuously collected within the receptacle away from contact with the patient's skin, wherein the mattress facilitates maintaining the patient's body in a comfortable position while the patient's anus and urethra are maintained continuously over the second aperture for the continuous collection of human waste products, wherein the horizontal portion of the absorbent pad is removably coupled to the top of the mattress such that the second aperture receives the receptacle of the absorbent pad and removal of the absorbent pad and the receptacle coupled thereto is accomplished from above the mattress;

a bed frame configured to support said mattress.

* * * * *